US005945025A

United States Patent [19]

Cunningham

[11] Patent Number: 5,945,025

[45] Date of Patent: Aug. 31, 1999

[54] FIRE EXTINGUISHING COMPOSITION AND METHOD FOR FIRE EXTINGUISHING

[76] Inventor: James A. Cunningham, 89-26 237th St., Bellrose, N.Y. 11426

[21] Appl. No.: 08/986,803

[22] Filed: Dec. 8, 1997

[51] Int. Cl.[6] ..... A62D 1/06

[52] U.S. Cl. ..... 252/7; 252/2

[58] Field of Search ..... 252/2, 3, 7; 169/46, 169/47

[56] References Cited

U.S. PATENT DOCUMENTS

| | | | |
|---|---|---|---|
| 914,233 | 3/1909 | Breslauer | 252/7 |
| 1,278,716 | 9/1918 | Mork | 252/7 |
| 1,908,398 | 8/1933 | Beythein | 252/3 |
| 3,055,435 | 9/1962 | Warnock et al. | 169/31 |
| 3,267,030 | 8/1966 | Dessart | 252/7 |
| 3,274,105 | 9/1966 | Mevel | 252/2 |
| 3,425,939 | 2/1969 | Asnieres et al. | 252/7 |
| 3,616,859 | 11/1971 | Shay et al. | 252/3 |
| 3,684,018 | 8/1972 | Rainaldi et al. | 252/3 |
| 3,750,754 | 8/1973 | Stults | 169/9 |
| 3,752,234 | 8/1973 | Degginger et al. | 252/3 |
| 3,849,315 | 11/1974 | Chiesa, Jr. et al. | 252/3 |
| 3,929,649 | 12/1975 | Rossmy et al. | 252/3 |
| 3,952,075 | 4/1976 | Nakamura et al. | 252/351 |
| 3,957,658 | 5/1976 | Chiesa et al. | 252/3 |
| 3,975,318 | 8/1976 | Larsen et al. | 521/136 |
| 3,975,319 | 8/1976 | Larsen et al. | 521/136 |
| 4,038,195 | 7/1977 | Chiesa, Jr. et al. | 252/3 |
| 4,060,489 | 11/1977 | Chiesa, Jr. et al. | 252/3 |
| 4,076,540 | 2/1978 | Stossel | 252/2 |
| 4,173,538 | 11/1979 | Herbline | 252/8 |
| 4,756,839 | 7/1988 | Curzon et al. | 252/2 |

*Primary Examiner*—Joseph D. Anthony
*Attorney, Agent, or Firm*—Frishauf, Holtz, Goodman, Langer & Chick, P.C.; Robert P. Michal

[57] ABSTRACT

A fire fighting composition including sodium bicarbonate, potassium bicarbonate and a potassium salt of an organic acid having 1 to 6 carbon atoms, such as potassium citrate. When mixed with water, the composition can be sprayed as a solution on fires.

9 Claims, No Drawings

FIRE EXTINGUISHING COMPOSITION AND METHOD FOR FIRE EXTINGUISHING

BACKGROUND OF THE INVENTION

1. Field of the invention

The present invention concerns a fire extinguishing composition and a method for fire extinguishing using such fire extinguishing composition.

2. Background information

Various types of fire extinguishing compounds and compositions are known, such as carbon dioxide, liquid extinguishing compositions and powder sprays.

Fluorine-containing fire extinguishing compounds are disclosed in U.S. Pat. No. 3,849,315; U.S. Pat. No. 3,752,234; U.S. Pat. No. 3,952,075; U.S. Pat. No. 3,957,658; and U.S. Pat. No. 4,038,195.

Polyfuran foam fire extinguishing compositions are discussed in U.S. Pat. No. 3,975,318 and U.S. Pat. No. 3,975,319.

Foams for use in fire fighting are disclosed in U.S. Pat. No. 3,616,859; U.S. Pat. No. 3,684,018; U.S. Pat. No. 3,750,754; U.S. Pat. No. 4,060,489; and U.S. Pat. No. 3,929,649.

Other fire fighting compositions are described in U.S. Pat. No. 4,076,540 and U.S. Pat. No. 4,173,538.

Gurzon et al. U.S. Pat. No. 4,756,839 concerns a fire extinguishing composition including potassium carbonate, a boron-containing compound, water and optionally a potassium salt of an organic acid.

It is important for fire extinguishing compositions to provide a good fire knock down ability, while having limited to moderate volatility and avoiding reignition.

It is furthermore important that fire extinguishing compositions remain in a fluid state so that the compositions can be readily sprayed.

SUMMARY OF THE INVENTION

It is an object of the present invention to provide a fire extinguishing composition which results in a good fire knock down.

It is a further object of this invention to furnish a fire extinguishing composition which has a low volatility.

It is still a further object of the present invention to provide a fire extinguishing composition which when mixed with water remains as a fluid and can be sprayed and thus does not solidify.

The above objects are satisfied by the fire extinguishing composition of the present invention which, on a dry basis, consists essentially of 2 to 3.5 weight % of sodium bicarbonate, 10 to 15 weight % of potassium bicarbonate and 84 to 86% of a potassium salt of an organic acid having 1 to 6 carbon atoms.

When the above composition is mixed with water, an aqueous solution is formed, wherein the amounts of the components are as follows:

0.8 to 1.2 weight % sodium bicarbonate 4 to 8 weight % potassium bicarbonate 40 to 44 weight % potassium salt of an organic acid having 1 to 6 carbon atoms and the remainder being water.

The present invention also relates to a method of fighting a fire by applying to a fire an effective fire fighting amount of the above described aqueous solution.

DETAILED DESCRIPTION OF THE INVENTION

The fire fighting composition of the present invention contains a mixture of sodium bicarbonate (or lithium bicarbonate), potassium bicarbonate (or lithium bicarbonate) and a potassium salt of an organic acid having 1 to 6 carbon atoms, which is preferably potassium citrate. These constituents, when mixed with water (such as tap water) form a clear aqueous foam, which is effective for fighting fires.

On a dry basis, the fire fighting composition of the present invention includes 2 to 3 weight %, such as 2.5 to 3.5 weight %, preferably 2.5 to 3 weight % and most preferably 2.1 to 2.3 weight % of sodium bicarbonate; 10 to 15 weight %, preferably 12 to 15 weight % and most preferably 12.5 to 13.5 weight % of potassium bicarbonate; and 84 to 86 weight %, preferably 84 to 85 weight % and most preferably 84.5 to 85 weight % of a potassium salt of an organic acid having 1 to 6 carbon atoms.

The potassium salt of an organic acid can be, for example, potassium citrate, potassium acetate or potassium tartrate. The preferred potassium salt of an organic acid is potassium citrate.

When the above described fire fighting composition is mixed with water, an aqueous solution is formed having the following composition: 0.8 to 1.2 weight %, preferably 0.8 to 1.0 weight % and most preferably 0.9 to 1 weight % of sodium bicarbonate; 4 to 8 weight %, preferably 4 to 6 weight % and most preferably 5.5 to 6 weight % of potassium bicarbonate; and 40 to 44 weight %, preferably 40 to 43 weight % and most preferably 41 to 42 weight % of a potassium salt of an organic acid having 1 to 6 carbon atoms, with the remainder being water.

In the above described compositions, lithium bicarbonate can be used to replace a portion or all of the sodium bicarbonate and/or a portion or all of the potassium bicarbonate.

The fire fighting composition of the present invention is effective in the absence of a boron-containing compound.

The above described constituents have the following properties.

Sodium Bicarbonate

Sodium bicarbonate is also known as sodium hydrogen carbonate, sodium acid carbonate or baking soda. The empirical formula for sodium bicarbonate is $NaHCO_3$, and the molecular weight of sodium bicarbonate is 84.00. The elemental breakdown of sodium bicarbonate is as follows: 14.29% carbon, 1.20% hydrogen, 27.37% sodium and 57.14% oxygen. Commercial sodium bicarbonate is about 99.8% pure.

Sodium bicarbonate can be prepared from sodium carbonate, water and carbon dioxide.

Sodium bicarbonate is in the form of a white crystal powder or granules. Sodium bicarbonate begins to lose $CO_2$ at 50° F. and at 100° F. it is converted into $Na_2CO_3$. Sodium bicarbonate is readily decomposed by weak acids.

In aqueous solution, sodium bicarbonate begins to breakup into carbon dioxide and sodium carbonate at about 20° F. and completely on boiling. Sodium bicarbonate is soluble in 10 parts water at 25° F., in 12 parts water at about 18° F., and is insoluble in alcohol. An aqueous solution of sodium bicarbonate can be prepared with cold water and without agitation and is only slightly alkaline to litmus or phenolphthalein; on standing or with a rise in temperature, the alkalinity increases. The pH of a freshly prepared 0.1 molar aqueous solution of sodium bicarbonate at 25° F. is 8.3.

Commercial uses of sodium bicarbonate include sodium salts, a source of $CO_2$, an ingredient of baking powder, effervescent salts and beverages and in cleaning compounds. Sodium bicarbonate can also be used in antacids, and in urinary and systemic alkalizers. Sodium bicarbonate can be utilized locally for treating burns, erytherma, to dissolve mucus and to exudate scabs.

In the use of the composition of the present invention to fight fires, sodium bicarbonate serves to reduce flashback.

Sodium bicarbonate has a negligible fire hazard when exposed to heat or flame.

With resect of toxicity, sodium bicarbonate has the following properties: Irritation data: 30 mg/3 days intermittent skin-human mild; 100 mg/30 seconds eye-rabbit mild. 1260 mg/kg oral-infant $TDL_o$ 4220 mg/kg oral-rat LD50: 3360 mg/kg oral-mouse LD50. Carcinogen status: None. Acute toxicity level: moderately toxic by ingestion. Persons at increased risk from exposure to sodium bicarbonate include persons with renal disorders or hypertension. Possible interactions with medications have been reported.

Potassium Bicarbonate

Potassium bicarbonate is otherwise known as potassium acid carbonate, Kafyloxx and K-Lyte. The empirical formula of potassium bicarbonate is $KHCO_3$ and potassium bicarbonate has a molecular weight of 100.11. The elemental breakdown of potassium bicarbonate is as follows: 11.99% carbon, 1.01% hydrogen, 39.05% potassium and 47.94% oxygen. Potassium bicarbonate is in the form of colorless, transparent crystals, white granules or powder.

$KHCO_3$ is soluble in 2.8 parts water, 2 parts water at 50° F. Potassium bicarbonate is practically insoluble in alcohol and has a pH of 8.2 (in 0.1 molar concentration).

Commercial uses of potassium bicarbonate include in baking powders, effervescent salts, in antacids and as a potassium supplement.

The use of potassium bicarbonate in the composition of the present invention, rather than potassium carbonate, serves to reduce the tendency of the composition to solidify.

Potassium bicarbonate has a negligible fire hazard when exposed to heat or flame.

Potassium Citrate

Potassium citrate is otherwise known as Urocit-K. The empirical formula of potassium citrate is $C_6H_5K_3O_7$, and the molecular weight of potassium citrate is 306.40. The elemental breakdown of potassium citrate is as follows: 23.52% carbon, 1.64% hydrogen, 38.28% potassium and 36.55% oxygen. Potassium citrate is in the form of monohydrate, white crystals, granules or powder. Potassium citrate loses its water at 180° F.

One gram of potassium citrate dissolves in 0.65 ml of water and dissolves very slowly in glycerol. Potassium citrate is practically insoluble in alcohol. An aqueous solution of potassium citrate is alkaline to litmus, and has a pH about 8.5. Commercial uses of potassium citrate include as an antiurolithic, an antacid and a diuretic.

Potassium citrate may cause mild skin irritation. Excessive inhalation of potassium citrate may cause minor respiratory tract irritation. Eye contact with potassium citrate dust may cause irritation, since the dust is abrasive.

Potassium citrate has a negligible fire hazard when exposed to heat or flame.

The fire fighting composition of the present invention in the form of an aqueous solution may be dispensed from a pressurized can or a mechanical pump or any other device from which the solution can be projected.

EXAMPLES

Example 1

| Components | | |
|---|---|---|
| Sodium Bicarbonate | 1.5 grams | .86 wt. % |
| Potassium Citrate | 78.0 grams | 44.44 wt. % |
| Potassium Bicarbonate | 6.0 grams | 3.42 wt. % |
| Water | 90.0 grams | 51.28 wt. % |
| Properties | | |
| Fire Knock Down | Excellent | |
| Volatility | Limited | |
| Reignition | None | |

The above composition is prepared by mixing the above components at a temperature of about 80° F.

This is the preferred composition.

Analytical Results for the Composition of Example 1 Corrosivity towards steel <6.35 mm/yr.

pH 9.3

Exothermic reactions—none detected

Endothermic reactions—none detected

Oxidation rate—minimal

Reactivity towards water—no reaction

Reactivity towards acids—mild effervescence with 1 normal

HCl may react violently and release carbon dioxide in the presence of a strong acid.

Reactivity towards caustics—no reaction

Decomposition—thermal decomposition may include toxic oxides of carbon

Flash Point: >140° F.

Boiling Point: 213.1° F.

Freezing Point: 31.8° F.

Effects of pressurization with nitrogen ($N_2$)—No negative effects detected at a pressurization of 40 psi.

Example 2

| Components | |
|---|---|
| Sodium Bicarbonate | 2.6 grams |
| Potassium Citrate | 100.0 grams |
| Potassium Bicarbonate | 15.0 grams |
| Water | 120.0 grams |
| Properties | |
| Fire Knock Down | Good |
| Volatility | Moderate |
| Reignition | None |

Example 3

| Components | |
|---|---|
| Sodium Bicarbonate | 8.0 grams |
| Potassium Citrate | 55.0 grams |
| Potassium Bicarbonate | 3.5 grams |
| Water | 45.0 grams |
| Properties | |
| Fire Knock Down | Good |

-continued

| | |
|---|---|
| Volatility | Moderate |
| Reignition | None |

Example 4

| Components | |
|---|---|
| Sodium Bicarbonate | 6 grams |
| Potassium Citrate | 135 grams |
| Potassium Bicarbonate | 26 grams |
| Water | 140 grams |
| Properties | |
| Fire Knock Down | Poor |
| Volatility | High |
| Reignition | None |

Example 5

| Components | |
|---|---|
| Sodium Bicarbonate | 12.0 grams |
| Potassium Citrate | 35.0 grams |
| Potassium Bicarbonate | 8.5 grams |
| Water | 45.0 grams |
| Properties | |
| Fire Knock Down | Poor |
| Volatility | High |
| Reignition | occurred |

The compositions of Examples 2 to 5 are prepared in the same manner as the composition of Example 1 is prepared, namely by mixing the components at a temperature of about 80° F.

It will be appreciated that the instant specification is set forth by way of illustration and limitation, and that various modifications and changes may be made without departing from the spirit and scope of the present invention.

What is claimed is:

1. A fire extinguishing composition consisting essentially of (a) 2 to 3 weight % of sodium bicarbonate, (b) 10 to 15 weight % of potassium bicarbonate, and (c) 84 to 86 weight % of a potassium salt of an organic acid having 1 to 6 carbon atoms.

2. The composition of claim 1, wherein the potassium salt of an organic acid having 1 to 6 carbon atoms is potassium citrate.

3. The composition of claim 2, wherein the sodium bicarbonate is in an amount of 2.5 to 3.5 weight %.

4. The composition of claim 1, wherein the sodium bicarbonate is in an amount of 2.5 to 3 weight %, the potassium bicarbonate is in an amount of 12 to 15 weight % and the potassium salt of an organic acid having 1 to 6 carbon atoms is in an amount of 84 to 85 weight %.

5. The composition of claim 4, wherein the potassium salt of an organic acid having 1 to 6 carbon atoms is potassium citrate.

6. The composition of claim 1, wherein the sodium bicarbonate is in an amount of 2.1 to 2.3 weight %, the potassium bicarbonate is in an amount of 12.5 to 13.5 weight % and the potassium salt of an organic acid having 1 to 6 carbon atoms is in an amount of 84.5 to 85 weight %.

7. The composition of claim 6, wherein the potassium salt of an organic salt having 1 to 6 carbon atoms is potassium citrate.

8. A fire extinguishing composition consisting essentially of (a) 2 to 3 weight % of a bicarbonate selected from the group consisting of sodium bicarbonate and lithium bicarbonate;

(b) 10 to 15 weight % of potassium bicarbonate; and (c) 84 to 86 weight % of potassium citrate.

9. A fire extinguishing composition consisting essentially of (a) 2 to 3 weight % of sodium bicarbonate;

(b) 10 to 15 weight % of a bicarbonate selected from the group consisting of potassium bicarbonate and lithium bicarbonate; and (c) 84 to 86 weight % of potassium citrate.

* * * * *